United States Patent [19]

Forth, Jr.

[11] 4,009,970

[45] Mar. 1, 1977

[54] RESILIENT FAN HUB

[76] Inventor: Claude A. Forth, Jr., 777 Park Drive, Fortville, Ind. 46040

[22] Filed: Jan. 15, 1975

[21] Appl. No.: 541,155

[52] U.S. Cl. ..... 416/134 R; 416/214 R

[51] Int. Cl.[2] ..... F04D 29/20

[58] Field of Search ..... 416/134, 214; 403/225–228; 64/27 R, 27 NM

[56] References Cited

UNITED STATES PATENTS

| | | | |
|---|---|---|---|
| 2,129,933 | 9/1938 | Hueglin | 416/134 X |
| 2,303,832 | 12/1942 | Funk | 416/134 X |
| 2,653,459 | 9/1953 | Morrill | 416/134 X |
| 2,773,365 | 12/1956 | Delf et al. | 416/134 X |
| 2,853,140 | 9/1958 | Forth | 416/134 |
| 3,084,963 | 4/1963 | Beehler | 403/226 |
| 3,159,391 | 12/1964 | Wilfert et al. | 403/225 X |
| 3,376,057 | 4/1968 | Van Buren | 403/225 X |
| 3,409,489 | 11/1968 | Renton | 416/134 X |
| 3,567,335 | 3/1971 | David et al. | 416/134 |
| 3,893,555 | 7/1975 | Elmer | 416/134 X |

FOREIGN PATENTS OR APPLICATIONS

| | | | |
|---|---|---|---|
| 1,262,037 | 4/1961 | France | 403/227 |

*Primary Examiner*—Everette A. Powell, Jr.
*Attorney, Agent, or Firm*—Woodard, Weikart, Emhardt & Naughton

[57] ABSTRACT

Disclosed is a hub assembly for resiliently mounting a driven element such as a fan, blower wheel or the like on a motor shaft. The body portion of the hub is particularly adapted to be formed by die casting and use of a simple, pressed-on fastener to clamp the resilient members, fan spider and hub body together results in a hub assembly requiring only a minimum of manufacturing and assembly operations.

2 Claims, 4 Drawing Figures

RESILIENT FAN HUB

BACKGROUND OF THE INVENTION

Fan hubs which resiliently mount fan blades are well known in the prior art. Usually these require the stacking of a group of resilient (rubber) sleeves, washers, spacers and the like and the swaging of the protruding end of the hub body so as to clamp the components in stacked relation. An example of this type of prior art structure is disclosed in U.S. Pat. No. 2,773,365.

The hub assembly of the present invention utilizes a hub body, which can be die cast, two resilient components and a fastener which is pressed on the hub body to clamp the assembly and the fan spider, or central apertured disc, together. No screw machine parts are required as components of the assembly and only a minimum of assembly operations are required.

DESCRIPTION OF THE PREFERRED EMBODIMENT

Figure 1:
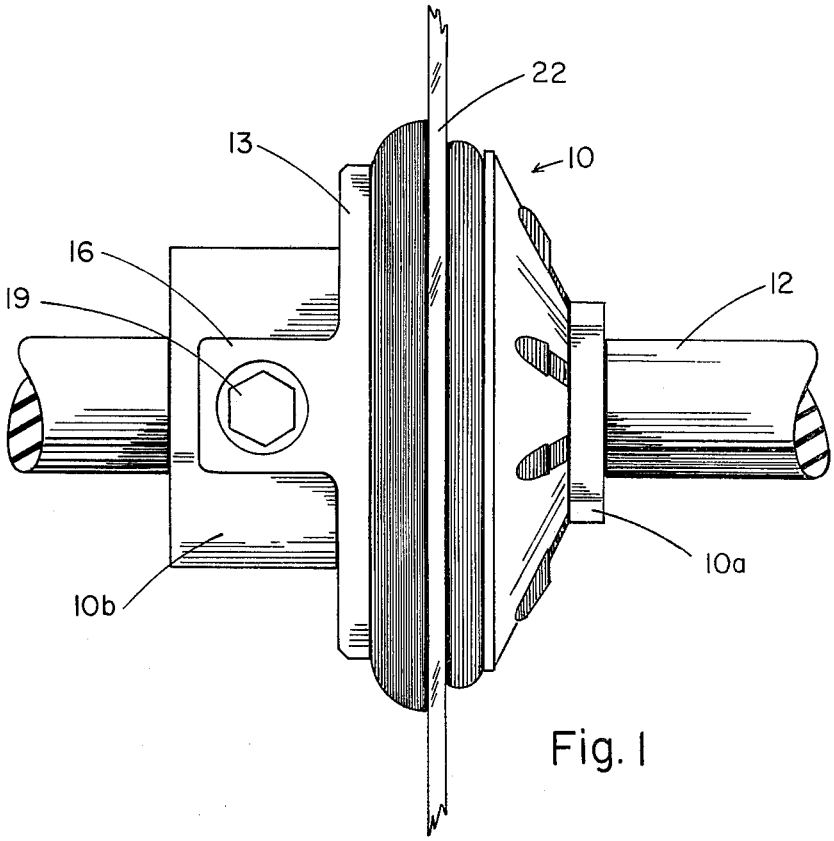
FIG. 1 is a side view of the hub assembly of the present invention shown on a driving shaft and with the fan spider shown fragmentarily.

Referring to the drawings, the hub assembly includes a hub body 10, having a central bore 11 (FIG. 4) through which a driving shaft 12 extends. The hub body is preferably cast of an aluminum alloy and is provided with an integral, radially extending flange 13. The body extends at reduced diameter, indicated at 10*a*, from one face of the flange and has a portion 10*b* extending from the opposite face of the flange. As will be evident from FIG. 4, the outside diameter of the portion 10*a* increases somewhat toward its junction with washer 13 so that a slight taper is provided.

The body portion 10*b* is formed so as to provide two diametrically opposite embossments 16 and 17. The embossment 16 has a tapped, radial aperture 18 which is adapted to accommodate a set-screw 19 (FIG. 1) or other suitable fastener, for locking the body 10 to the drive shaft 12. The opposite embossment 17 is present merely to balance its counterpart.

Figure 4:
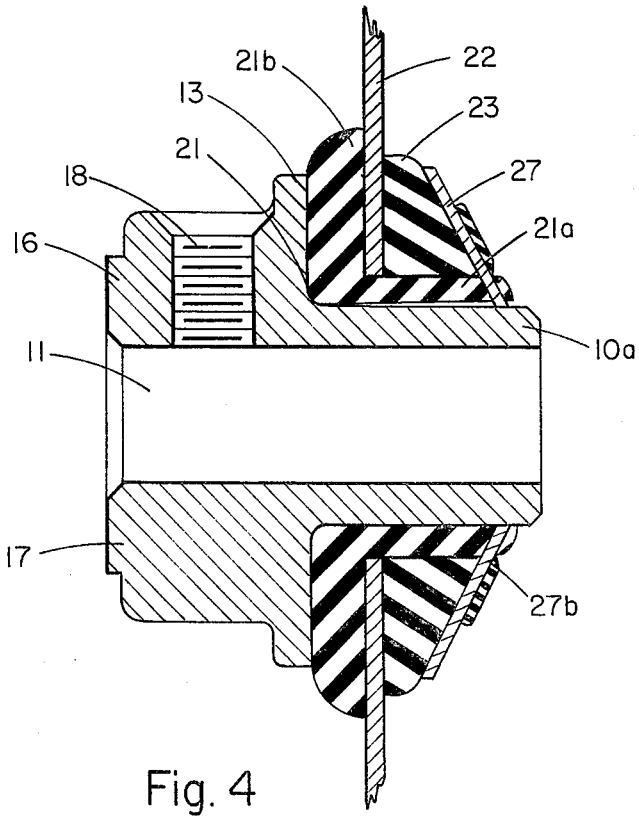
FIG. 4 is a side sectional view of the hub assembly shown in FIG. 1.
Figure 2:
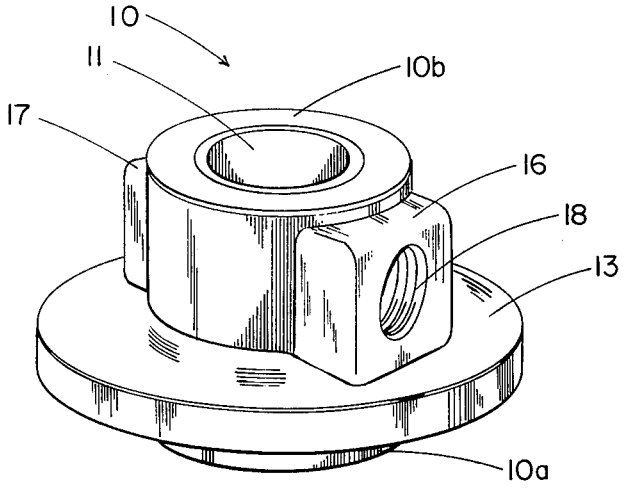
FIG. 2 is a perspective view of the hub body.

As may best be seen in FIG. 4, a resilient grommet 21, which may be formed of rubber, has a tubular portion 21*a* through and beyond which the body portion 10*a* extends. This portion 21*a* of the grommet extends through the central opening in a conventional spider or central disc 22 carrying fan blades (not shown). The grommet is further formed to provide a radially extending portion 21*b* which is contiguous to the flange 13 on one face and with the fan spider 22 on its opposite face. The grommet portion 21*a* also extends through an annular, resilient washer 23 which engages the adjacent face of the fan spider 22.

Figure 3:
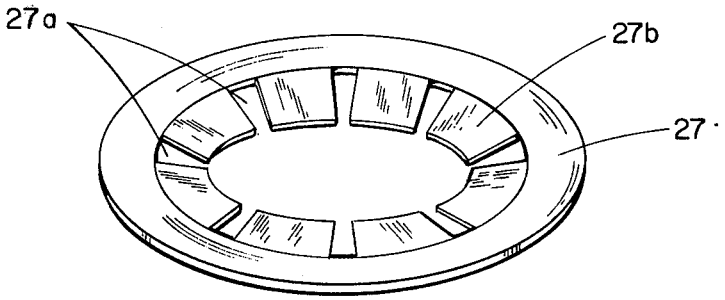
FIG. 3 is a perspective view of the retainer or fastener member.

The assembly is clamped together, with the grommet 21 and washer 23 in compressed condition, by means of a fastener taking the form of a concavo-convex, annular plate 27, preferably formed of spring steel. The margin of the central aperture in the plate is broken by a series of radial slots 27*a* (FIG. 3) forming fingers 27*b* which engage the tapered surface of the body portion 10*a* and lock the fastener on the body.

In assembling the hub structure, the grommet 21 is placed on the hub body with portion 21*b* overlying the integral flange 13. The fan spider 22 is then placed on the grommet. The resilient washer 23 is placed on the grommet and against the adjacent face of the fan spider. The spring steel fastener 27 is then pressed on the hub portion 10*a* so that the grommet and resilient washer are placed under compression and protrude slightly from the slots 27*a*. As will be evident from FIG. 4, the fan spider is then resiliently mounted on the hub (no metal-to-metal contact) and the hub can be fastened to a driving shaft by means of set screw 19. The assembly operations are thus simple and minimum in number. No swaging operation is necessary to clamp the stacked components in assembled relation. The cast hub material is kept to a minimum by forming the two diametrically opposite embossments rather than increasing the complete diameter of the body portion to provide support for the shaft-engaging set screw.

While the invention has been disclosed in some detail in the drawings and foregoing description, they are to be considered as illustrative and not restrictive in character, as other modifications within the scope of the invention may readily suggest themselves to persons skilled in the art.

I claim:

1. In combination, a hub assembly, a drive shaft, a driven element such as a fan spider having a center disc with a central aperture therein, said hub comprising a body having a central bore therethrough and an integral flange extending radially from the body intermediate its ends, an embossment formed on said body adjacent one face of said flange adapted to accommodate a set screw engaging said driving shaft when received in said central bore, a resilient grommet having a tubular portion through and beyond which said hub body extends and a radially extending portion contiguous with said body flange on one face, said tubular portion extending through said center disc aperture with a face of said disc contiguous with the outer face of said radially extending portion of the grommet, an annular resilient washer received on said tubular portion of the grommet and contiguous with the other face of said disc, and a single annular slide-on fastener received on the portion of the hub body which extends beyond said grommet, said fastener having a plurality of gripping radial legs extending away from said center disc and engaging said hub body, said fastener forming the sole means for compressing said resilient washer and grommet against said fan center disc and said integral body flange.

2. A hub as claimed in claim 1 in which said portion of the hub body protruding beyond said grommet has an outside diameter which increases toward said washer to thereby provide a slightly tapered surface receiving said fastener.

* * * * *